United States Patent [19]

Gordon

[11] Patent Number: 5,000,288

[45] Date of Patent: Mar. 19, 1991

[54] SWIMMING POOL MAINTENANCE SEAT

[76] Inventor: Bradford C. Gordon, 17 S. Riata Dr., Gilbert, Ariz. 85234

[21] Appl. No.: 542,533

[22] Filed: Jun. 25, 1990

[51] Int. Cl.[5] ..... A47C 1/00

[52] U.S. Cl. ..... 182/150; 182/92; 182/206

[58] Field of Search ..... 182/150, 206, 187, 90, 182/92, 196; 297/273

[56] References Cited

U.S. PATENT DOCUMENTS

| | | | |
|---|---|---|---|
| 511,896 | 1/1896 | Killeen | 182/206 |
| 814,766 | 3/1906 | Chambers . | |
| 1,868,187 | 7/1932 | Avallone . | |
| 2,059,011 | 10/1936 | Moewes . | |
| 2,532,590 | 12/1950 | Anastasi . | |
| 2,847,059 | 8/1958 | Klins | 182/187 |
| 3,231,043 | 1/9166 | Brown . | |
| 3,961,686 | 6/1976 | Starkey | 182/187 |
| 4,312,536 | 1/1982 | Lloyd | 182/150 |

*Primary Examiner*—Reinaldo P. Machado
*Attorney, Agent, or Firm*—Norman B. Rainer

[57] ABSTRACT

A device having two C-shaped hooks and a connecting tether enable a person to assume a seated position within a swimming pool while cleaning the waterline zone of the side wall of the pool. The hooks are precisely contoured so that, when placed in angled relationship to the side wall, the lower end of the hook abuts against the side wall of the pool, and the upper portion of the hook rests upon a horizontal deck surface that surrounds the pool.

8 Claims, 2 Drawing Sheets

SWIMMING POOL MAINTENANCE SEAT

BACKGROUND OF THE INVENTION

1. Field of the Invention

This invention relates to a seating device, and more particularly concerns a seat to be used by a person performing maintenance work within a swimming pool.

2. Description of the Prior Art

Outdoor swimming pools often develop algeal growths on the sidewall and bottom portions of the pool. Removal of such growths generally requires a scrubbing treatment. The bottom portion of the pool can be effectively scrubbed by remotely operated devices powered by an electric or pneumatic motor, or can be manually scrubbed by means of long-handled brushes. The sidewall portions of the pool, however, and particularly the waterline region are not readily cleaned by machines or long-handled brushes. The waterline region requires greater than the usual amount of maintenance because of the deposition upon the sidewall at the waterline of oily materials such as suntan oil, air-borne debris, and residues of chemicals utilized in the regular treatment of the pool water.

In one approach to cleaning the waterline region of the sidewall, a person will enter the water, hold onto the edge or lip of the pool with one hand, and employ the other hand to manipulate a scrub brush or equivalent cleaning implement. In another technique, the person will kneel upon the lip and bend over to reach downwardly with the cleaning implement. Such techniques are extremely tiring and do not permit the person to apply adequate force upon the cleaning implement.

It is accordingly an object of this invention to provide a device for enabling a person to easily clean or repair the waterline region of the sidewall of a swimming pool.

It is another object of this invention to provide a device as in the foregoing object which will supportively position a person in the swimming pool in facing relationship to the sidewall.

It is a further object of the present invention to provide a device of the aforesaid nature which easily engages the lip of the swimming pool and is easily positionable horizontally along said lip.

It is a still further object of this invention to provide a device of the aforesaid nature of durable, simple construction amenable to low cost manufacture.

These objects and other objects and advantages of the invention will be apparent from the following description.

SUMMARY OF THE INVENTION

The above and other beneficial objects and advantages are accomplished in accordance with the present invention by a device for supportively positioning a person in seated position in facing relationship to the sidewall of a swimming pool bounded by a lip defined by the intersection of a horizontal deck surface that surrounds the pool and a vertical surface representing the sidewall portion of the pool, said device comprising:

(a) a pair of identical rigid C-shaped hooks, each comprised of upper and lower portions, a back portion extending between said upper and lower portions, opposed parallel flat surfaces, and inside and outside arcuate edges perpendicularly disposed to said flat surfaces and merging at rounded upper and lower end extremities, said lower portion having an aperture communicating between said flat surfaces, and (b) a length of flexible tether, the ends of which are secured to said hooks by penetrative engagement of said apertures.

In preferred embodiments of the device, the width of each hook, defined as the perpendicular distance between inside and outside edges, is substantially uniform throughout the hook. The exact shape and dimensions of the hook is selected such that, when placed in angled relationship against the sidewall with the lower rounded end contacting the sidewall, the inside edge adjacent the upper portion passes over said lip, extending to said upper end which rests upon said horizontal deck surface. The size of the opening of the hook, namely the distance of separation of said upper and lower portions at said inside arcuate edge is preferably in the range of 5" to 9". The length of the tether is preferably in the range of 6 to 8 feet.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
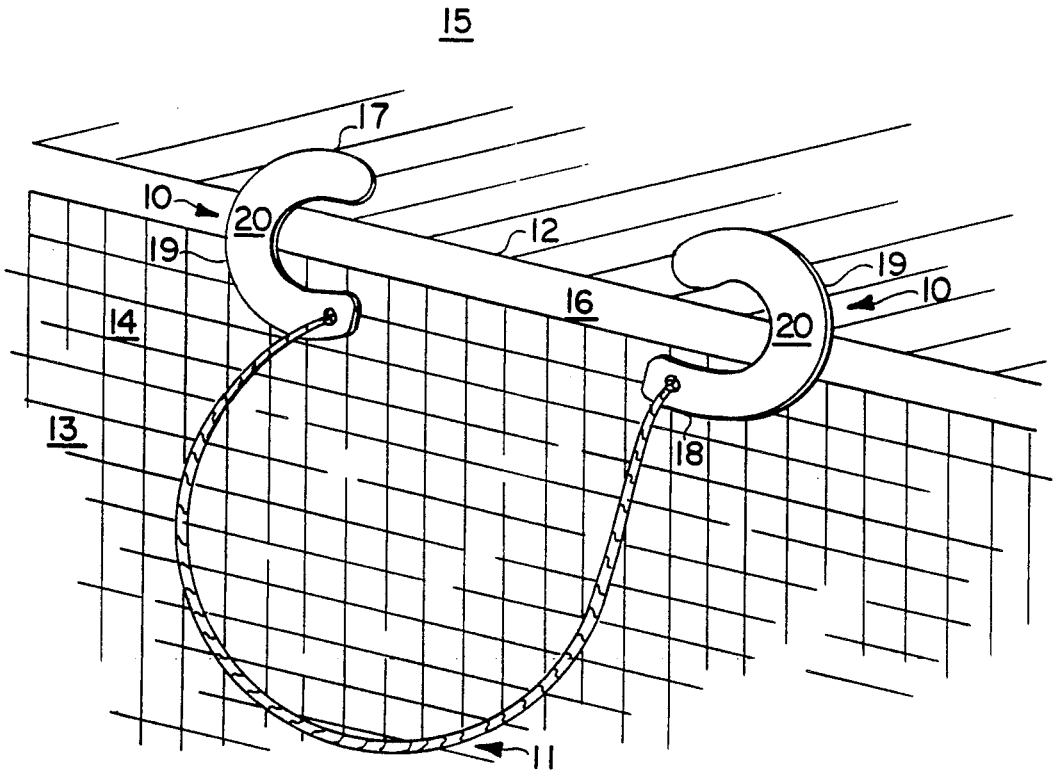
FIG. 1 is a perspective view of an embodiment of the device of the present invention shown in functional relationship with a swimming pool.
Figure 2:
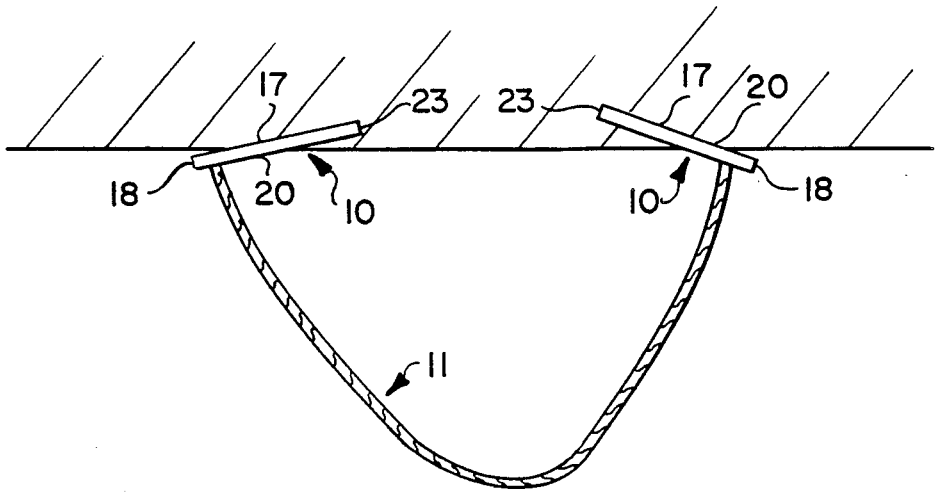
FIG. 2 is a top view of the embodiment of FIG. 1.

Referring to FIGS. 1–4, an embodiment of the device of this invention is shown comprised of paired identical hooks 10 interconnected by tether 11. The hooks Pass over the lip 12 of a 5 swimming pool 13 having vertical sidewall portions 14 and a concrete horizontal skirt or deck surface 15. The lip 12 represents the intersection of the deck surface with a vertical surface 16 representing the thickness of the deck surface and coplanar or identical with sidewall portion 14.

The hook is fabricated as a monolithic structure from rigid materials such as plastics, metal and wood. The hook, having a C-shape, is comprised of upper and lower portions 17 and 18, respectively, joined by back portion 19. The hook is hounded by opposed parallel flat surfaces 20 and inside and outside arcuate edges 21 and 22, respectively, perpendicularly disposed to said flat surfaces and merging at rounded upper and lower end extremities 23 and 24, respectively. An aperture 25, having a keyhole configuration and communicating between said flat surfaces, is located in lower portion 18. Other configurations of the aperture may, however be utilized.

Figure 3:
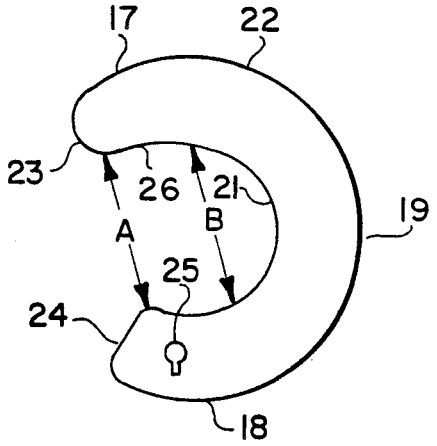
FIG. 3 is a side view of a first embodiment of the hook component.
Figure 4:
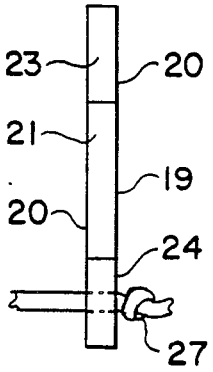
FIG. 4 is an end view of the hook component of FIG. 3.

As shown more clearly in FIG. 3, the shape and dimensions of the hook are critically selected so that, when the hook is placed at an angle with respect to the sidewall, upper portion 17 will pass over the lip and rest upon deck surface 15. The curvature of the inside and outside edges of the hook of FIG. 3 are substantially circular and concentric, causing the width of the hook to be substantially uniform throughout its length between said upper and lower portions. The extent of circular arc of said inside edge is about 223 degrees. Consequently, the distance of separation of rounded end extremities, 23 and 24, designated by line A and considered the opening of the hook, is somewhat smaller than the distance of separation of opposed portion of said inside edge, designated by line B and considered the inside diameter of the hook. A section 26 of said inside edge adjacent said upper portion, is a tangentially straight extension of the arcuate section of said inside edge.

Figure 5:
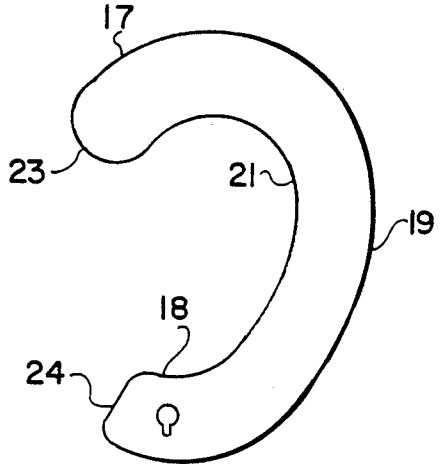
FIG. 5 is a side view of a second embodiment of the hook component.
Figure 6:
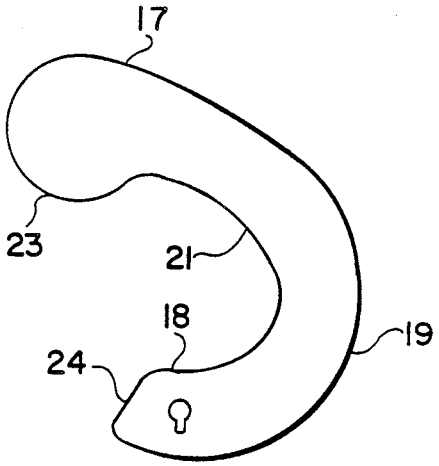
FIG. 6 is side view of a third embodiment of the hook component.
Figure 7:
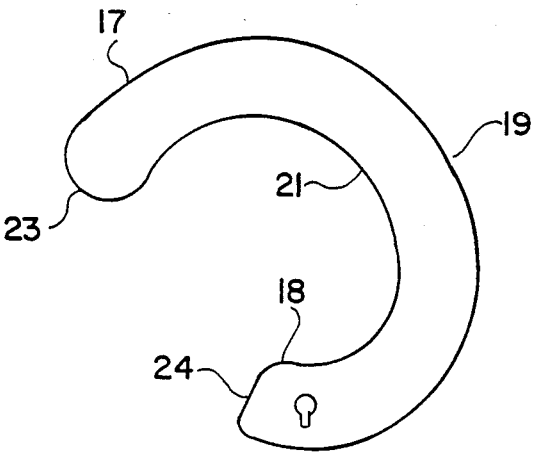
FIG. 7 is a side view of a fourth embodiment of the hook component.

FIGS. 5, 6 and 7 show embodiments of the hook having somewhat different contours However, in each case, the inside diameter is larger than the hook opening.

Tether 11 is preferably a rope of about ½" thickness fabricated of nylon, polypropylene, or hemp. The length of rope may range from about 6 to 8 feet and may have a padded cover. In the illustrated embodiment, knots 27 are formed at the extremities of the tether By virtue of said knots, the rope can enter the keyhole apertures and become securely associated with the hook and adjusted for length. Other generally equivalent means for attaching the tether to the hooks may however be employed.

In use, the hooks are placed in angled relationship to the sidewall of the pool and with the openings in facing juxtaposition. In such manner of emplacement, the hooks engage the lip of the pool and dispose the tether between them as a loop which can be utilized as a seat by a person using a scrub brush or other maintenance device The hooks are accordingly easily repositioned along the perimeter of the pool. Following use, the device requires no preventive maintenance, and may be stored in a very compact state.

In certain embodiments, a soft plastic or rubber boot may be disposed upon upper end extremity 23 to ensure non-sliding contact with the deck surface 15.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for supportively positioning a person in seated position in facing relationship to the sidewall portion of a swimming pool bounded by a lip defined by the intersection of a horizontal deck surface that surrounds the pool and a vertical surface representing the sidewall portion of the pool, said device comprising:

(a) a pair of identical rigid C-shaped hooks, each comprised of upper and lower portions, a back portion extending between said upper and lower portions, opposed parallel flat surfaces, and inside and outside arcuate edges perpendicularly disposed to said flat surface and merging at rounded upper and lower end extremities, said lower portion having an aperture communicating between said flat surfaces, and (b) a length of flexible tether, the ends of which are secured to said hooks by penetrative engagement of said apertures.

2. The device of claim 1 wherein the width of each hook, defined as the perpendicular distance between inside and outside edges, is substantially uniform throughout the hook.

3. The device of claim 1 wherein the shape and configuration of the hooks are such that, when placed in angled relationship against said sidewall portion with the lower rounded end contacting said sidewall portion, the inside edge passes over said lip, causing said upper end to rest upon said horizontal deck surface.

4. The device of claim 1 wherein the size of the opening of the hook, measured as the distance of separation of said upper and lower portions at said inside arcuate edge, is between 5 and 9 inches.

5. The device of claim 1 wherein the length of said tether is between 6 and 8 feet.

6. The device of claim 4 having an inside diameter greater than the size of said opening.

7. The device of claim 1 wherein said tether is secured by knotting to said hooks.

8. The device of claim 1 wherein said inside arcuate edge merges into a straight edge at said upper portion.

* * * * *